US007384045B1

(12) United States Patent
David

(10) Patent No.: US 7,384,045 B1
(45) Date of Patent: Jun. 10, 2008

(54) METHOD FOR PROVIDING A BLACKJACK DOUBLE DOWN WAGER

(75) Inventor: Ira David, Las Vegas, NV (US)

(73) Assignee: Millennium Systems Products, Inc., Las Vegas, NV (US)

( * ) Notice: Subject to any disclaimer, the term of this patent is extended or adjusted under 35 U.S.C. 154(b) by 212 days.

(21) Appl. No.: 11/313,602

(22) Filed: Dec. 20, 2005

(51) Int. Cl.
*A63F 1/00* (2006.01)

(52) U.S. Cl. ..... 273/292; 273/274

(58) Field of Classification Search ..... 273/292, 273/274, 309; 463/12
See application file for complete search history.

(56) References Cited

U.S. PATENT DOCUMENTS 5,538,252 A * 7/1996 Green ..... 273/306
5,702,104 A * 12/1997 Malek et al. ..... 273/292
5,954,335 A * 9/1999 Moody ..... 273/292
2006/0027967 A1* 2/2006 Chen ..... 273/292

* cited by examiner

*Primary Examiner*—Benjamin H Layno
(74) *Attorney, Agent, or Firm*—Morishita Law Firm LLC

(57) ABSTRACT

An improved double down wager for blackjack involves offering the player a split double option. The split double option may be either in lieu of, or in addition to, a standard double down option. Originally, when a player elects a split double option, the player places a wager increase to the initial wager. The dealer then deals the player n additional cards. Each of the cards is separately used in combination with the initial cards to form a separate player final hand. The total wager is likewise divided into individual wagers for each player final hand so constructed. Each player final hand is then evaluated and resolved against the dealer's final hand with individual wagers being separately resolved.

10 Claims, 5 Drawing Sheets

METHOD FOR PROVIDING A BLACKJACK DOUBLE DOWN WAGER

FIELD OF THE INVENTION

The present invention relates to gaming and gambling games. Specifically, the present invention is an improved double down wager for a card game played between a dealer and a player according to the conventional rules of Blackjack.

BACKGROUND OF THE INVENTION

Many casino games include players playing against the casino to obtain a player hand having a value closer to a target value than the house hand. Blackjack, for example, is a well known card game played in casinos. The object of the game is to have a final hand total closer to twenty-one than the dealer's final hand total without exceeding twenty-one. For purposes of calculating the final hand total, each card has a value equal to its face value except face cards, which have a value of ten, and aces, which may have a value of eleven or one as the player selects. In conventional Blackjack, the suit of the cards is irrelevant.

The form of Blackjack played in casinos is played between a dealer, representing the house, and at least one player. In a typical Blackjack game, each player makes a base wager in a wagering area on a playing surface. The dealer deals two cards to each player and two cards, one card face up and the other face down, to himself or herself.

If the dealer does not have a natural twenty one, any player receiving a natural twenty-one or Blackjack, i.e. a total of twenty-one in the initial dealt hand, is immediately rewarded, typically at a rate of 2:1, 3:2, or 6:5 and play is terminated as to that player. Each remaining player examines the player's hand and decides whether to hit, i.e. receive another card, or stand, i.e. stand on the player's current hand. A player may hit as many times as the player wishes as long as the player does not bust, i.e. receive a card causing his cumulative total to exceed twenty-one. When a player busts, the player's wager is immediately collected and play is terminated as to that player.

A player may also have additional options available depending on the initial player hand dealt. If the player receives a pair, i.e. two cards having the same face value, the player may split the pair and use each card as a basis for a separate hand. For example, if a player were to be dealt a pair of eights, the player may choose to split the pair and continue play with two hands each having an eight and an additional dealt card. Each of those individual hands is then played independently.

A player may also have the option to double down. Although the availability of the double down option vary from casino to casino, the option allows a player to double the player's wager in exchange for a single additional card. This option is typically selected when a player feels that he has a better than even chance of winning with drawing only a single card. This is often the case when the player has an initial two-card total of eleven, so that any face card will give the player a total of twenty-one, or when the dealer has a face-up card of a five or six, and the player feels it likely that the dealer will bust.

After all the players have played their hands, the dealer reveals the face-down card in the dealer's hand. The dealer plays the dealer's hand according to established house rules. That is, the casino uses established rules to eliminate the dealer's discretion. The dealer hits or stands as the house rules dictate, and resolves the wagers. In resolving the wagers, players with a final hand total closer to twenty-one than the dealer's final hand total are rewarded at 1:1. Conversely, wagers are collected from players with a final hand total further from twenty-one than the dealer's final hand total. If the dealer busts, all players who did not bust or receive a Blackjack are rewarded. If the player and dealer push, i.e. have the same final hand total, the player's wager is returned.

One drawback to this game is that players may be intimidated by the additional risk involved in the double-down wager. While the player may have a good chance of winning on the doubled wager, the all-or-nothing nature of the wager means that there is also a non-trivial chance that the player may lose double. Players may fear the disaster of holding an eleven and drawing an ace, and being "stuck" with a total of twelve. While the dealer may still bust, he may not, and the player will lose to any non-bust dealer hand. Many players may hesitate to take this risk. Thus, there is a need in the art for a method of reducing this risk of a doubled loss, while not affecting the expected value of the hand, for either the player or the casino.

SUMMARY OF THE INVENTION

The present invention is a an improved double-down wager for Blackjack. The double-down wager of the present invention is available whenever the casino would typically allow a conventional double-down wager. Generally double-down bets are allowed on initial two-card holdings of eleven or less, including "soft" totals, of an ace and a non-face card. Optionally, casinos may permit a double-down on other totals, or even after drawing of one or more additional cards. It is anticipated that the method recited herein may be permitted under the same rules as are presently offered for a double-down. Further, it is anticipated that the method recited herein may be offered as an alternate option to players, i.e. that a player may choose either a conventional double-down, or a double-split as described below.

DESCRIPTION

Figure 1:
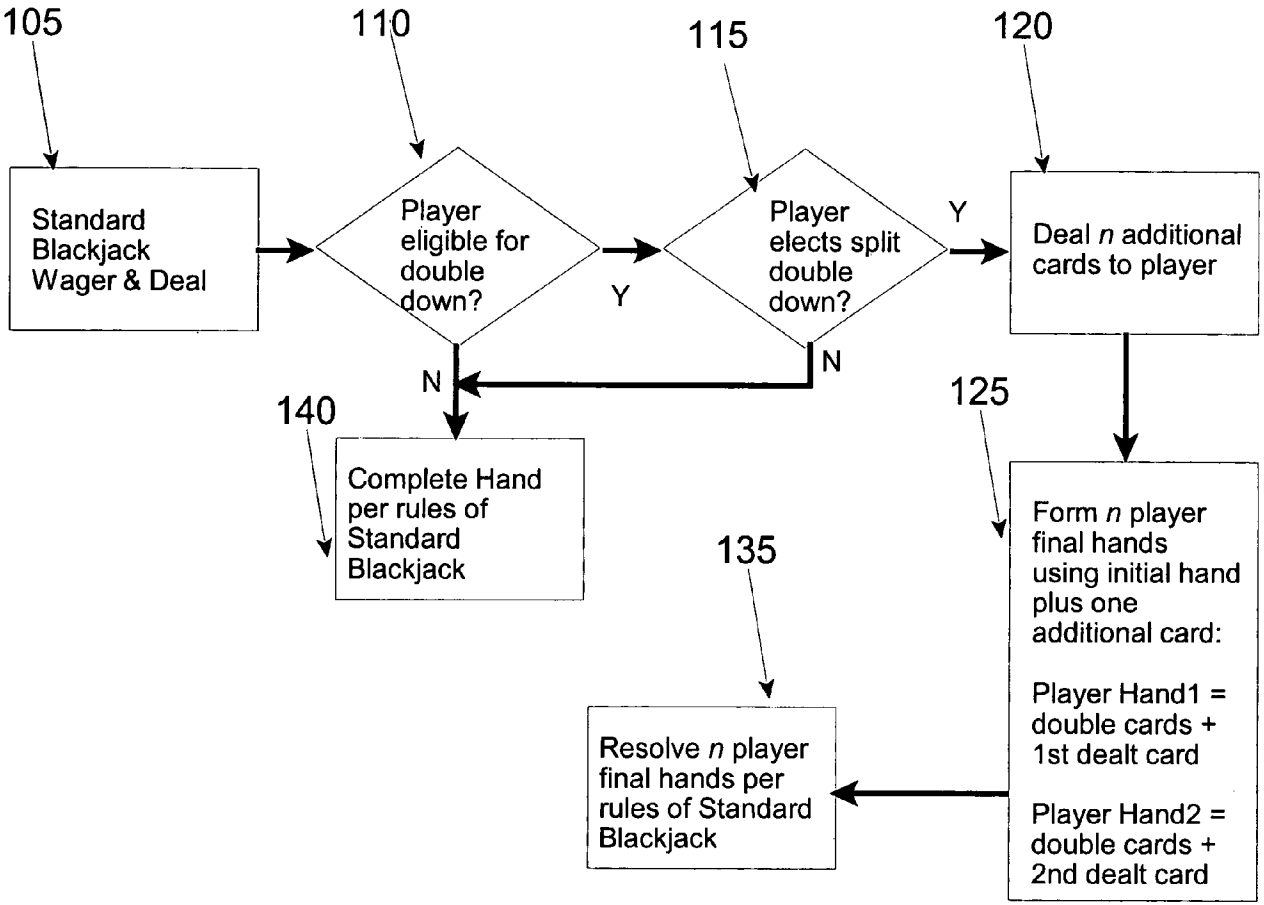
FIG. 1 is a flowchart of an embodiment of the method according to the present invention.
Figure 2A:
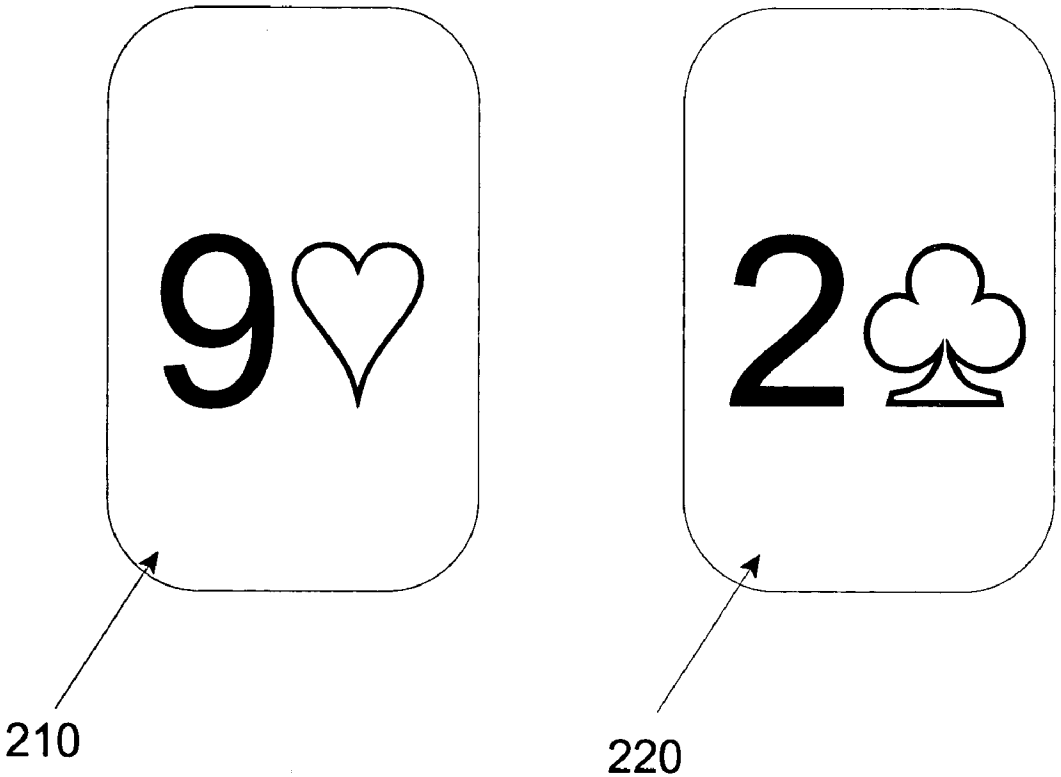
FIGS. 2A-D are views of an example hand conducted according to an embodiment of the present invention.
Figure 2B:
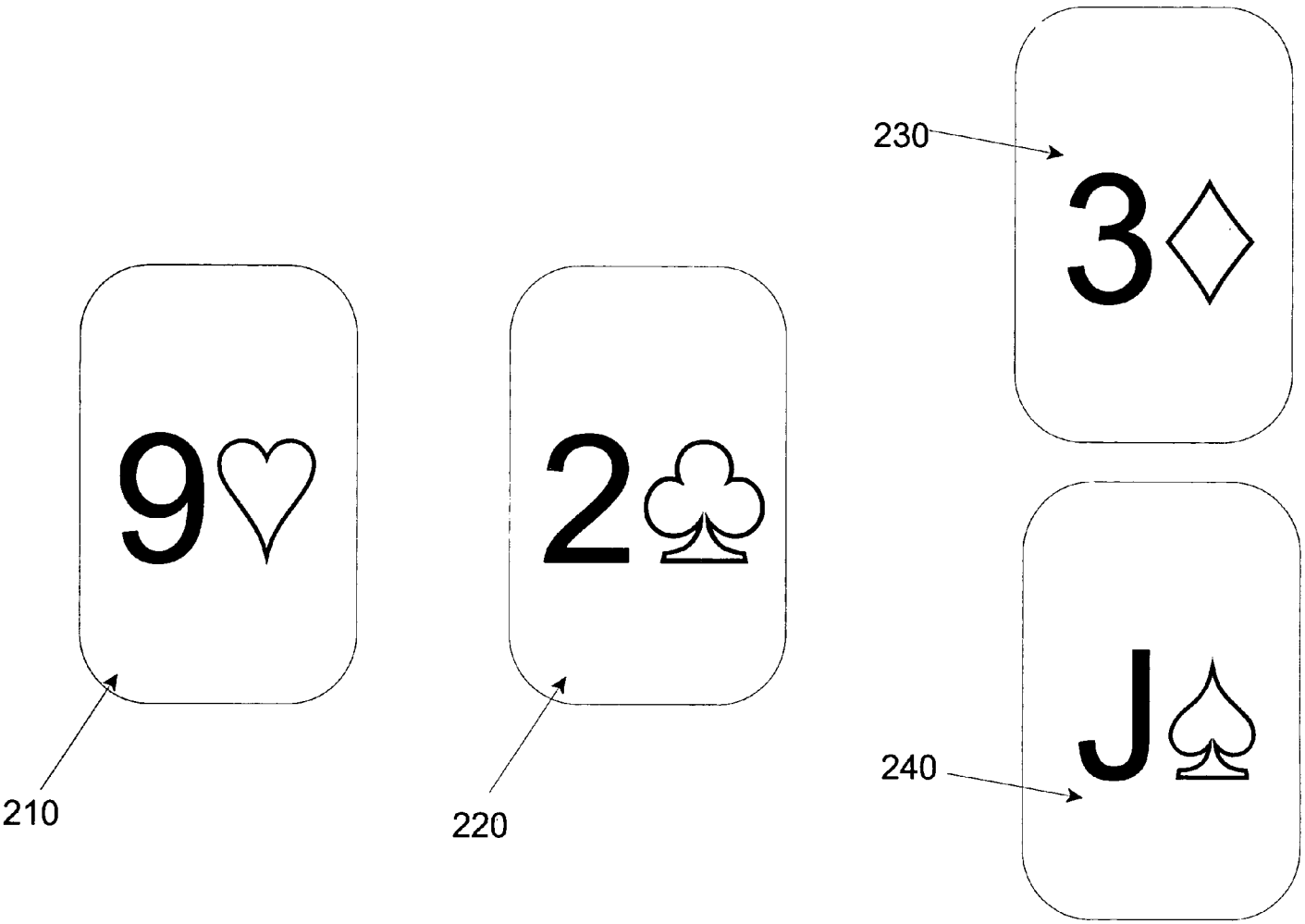
Figure 2C:
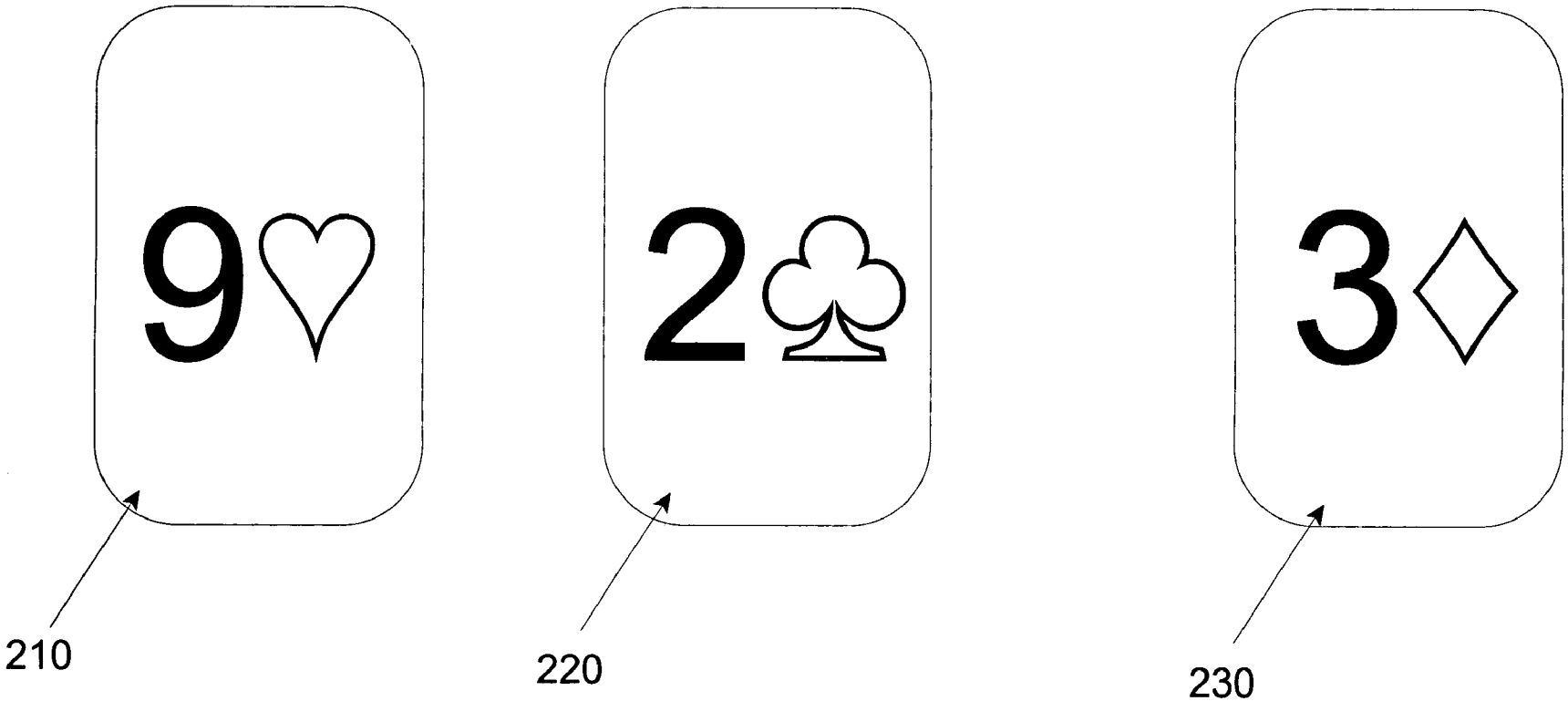
Figure 2D:
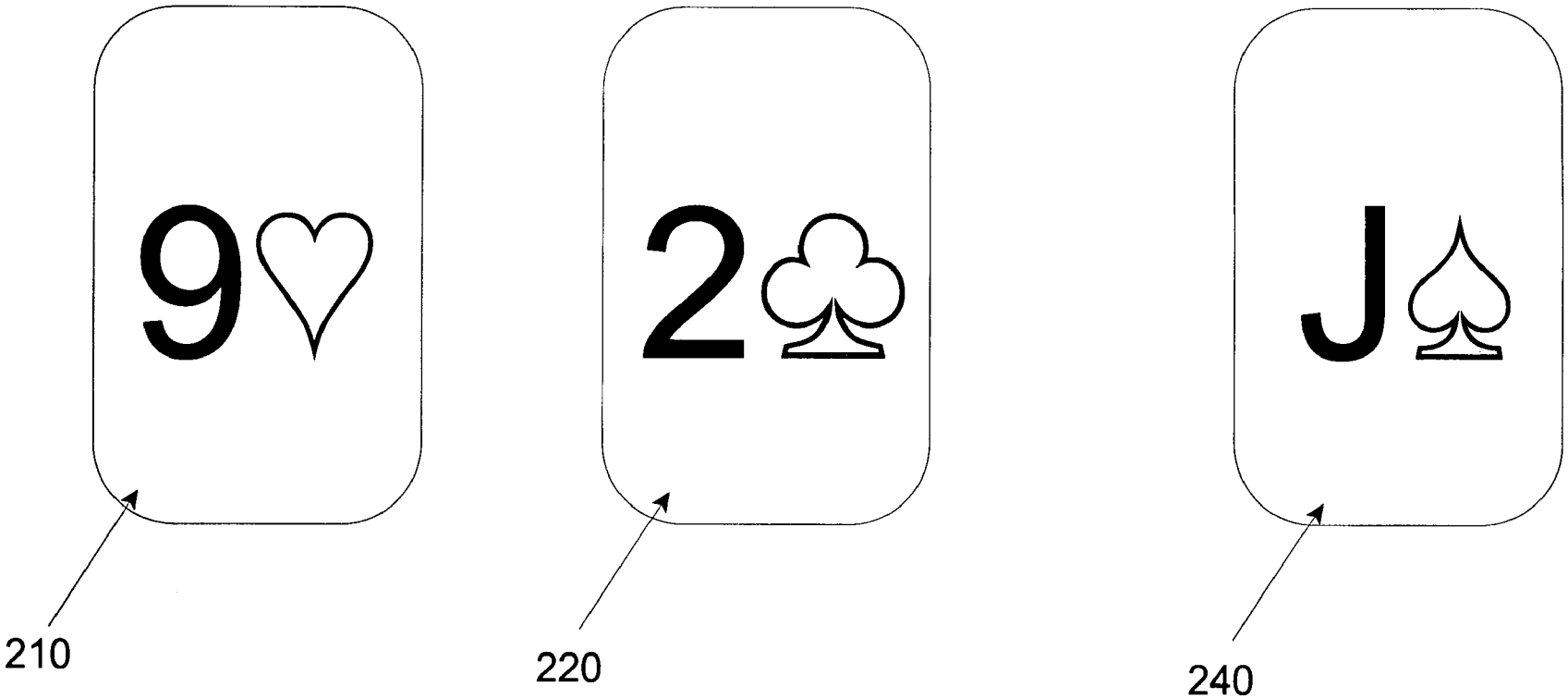

Reference is now made to the figures wherein like parts are referred to by like numerals throughout. As illustrated in FIG. 1, the method of the present invention commences with the standard wager and deal of a blackjack game 105 between a dealer and at least one player as is known in the art. If a player is not eligible for a double down according to the rules of the casino 110, the play is then concluded according to the standard rules of a blackjack game 140 as is known in the art. In the optional embodiment illustrated, a player hand would be eligible for a double down on any first two cards with a total value of ten or eleven, or any soft card total, i.e. an ace and any non-ten value card. In alternate embodiments, player double down may be permitted on other initial hands, or after one or more hits.

If eligible, a player may elect the split double 115. If the player opts not to exercise the split double down option, the hand is completed according to the standard rules of a blackjack game 140 as is known in the art. In the optional embodiment illustrated, a player may choose either a standard double down, or a split double down. In an alternate embodiment, the split double down option may replace the standard double down, so that no standard double down option would be offered. Any option other than a split double down is played according to the standard rules of a blackjack game 140 as is known in the art.

In one optional embodiment, the player may indicate election of a split double option by placing a wager increase in an amount equal to the player's initial wager behind the player's initial wager, and indicating a split double election by showing the dealer two fingers. Where there is a potential of confusion, typically where the player's initial hand consists of two fives, and the player has the options of a standard double down, a split double, or a split (dividing the fives as the first cards of two separate hands, to be dealt and acted upon individually), the distinction of placing the second wager behind the first shows that a double down option is desired, and the two finger signal indicates that the split double option is to be exercised, rather than a standard double down.

In an alternate optional embodiment, said player may indicate election of the split double option by placing a wager increase in an area upon the player's wagering area, allocated for split double wagers.

In the optional embodiment illustrated, a split double wager effects a wager increase in an amount equal to said player's initial wager. In alternate embodiments, a wager increase in an amount greater than said player's initial wager may be allowed, i.e. permitting said player to increase the amount wagered on each of said final hands, or a wager increase in an amount less than said player's initial wager may be allowed, i.e. either permitting said player to decrease the amount wagered on each of said final hands, or to leave the initial wager upon one of said final hands, and wager a reduced amount upon the other of the final hands. (It is anticipated that this last option of unequal wagers may only be permitted in instances where said player is wagering his final funds, and elects not to introduce additional funds into the games, i.e. is using his last chips and does not want to buy more. Just as a player is typically allowed to "double for less," he may be permitted to "split double for less.")

As illustrated in FIGS. 2A-2D, a player may elect a split double 115 upon an initial holding 210, 220 totaling eleven. Where a player does so elect, two cards 230, 240 are dealt to the player 120. Each of the dealt cards 230, 240 is then used in conjunction with the initial two cards 210, 220 to form a separate final hand 125. In the example illustrated, Hand1 would than consist of the 9 of hearts, the 2 of clubs, and the 3 of diamonds, for a total of 14. Hand2 would then consist of the 9 of hearts, the 2 of clubs, and the jack of spades, for a total of 21.

Play of the hand continues, and final resolution is performed individually for each hand formed 135 according to the standard rules of a blackjack game as is known in the art. Thus, in the example shown in FIGS. 2A-2D, should the dealer bust, the player would win on both Hand1 and Hand2; should the dealer draw to a final hand other than 21, the player would lose on Hand1, but win on Hand2, a net push, assuming winning hands are paid even money; should the dealer draw to a 21, the player would lose on Hand1, and push on Hand2, a net loss of the initial wager. It may be noted that under standard rules, had the player elected to double down and drawn the 3 of diamonds 230, said results would have been: on a dealer bust, a double win; on a dealer draw to any non-bust hand, a double loss. Had the player instead drawn said jack of spades 240, said results would have been: on a dealer bust, a double win; on a dealer draw to 21, a push, on a dealer draw other than 21, a double win. The expected value of the results are the same, but the exposure to the double loss is reduced.

While certain embodiments of the present invention have been shown and described it is to be understood that the present invention is subject to many modifications and changes without departing from the spirit and scope of the claims presented herein.

The invention claimed is:

1. An improved double down wager for a card game played between a dealer and a player according to the conventional rules of blackjack in which the player makes an initial wager, the dealer deals a two-card player initial hand to the player and a dealer initial hand to the dealer, one of the cards of said dealer initial hand dealt face-up, the player forms at least one player final hand by standing on said player initial hand or receiving at least one additional card, and the dealer forms a dealer final hand by standing on said dealer initial hand or receiving at least one additional card, the improved double down wager comprising the steps of:

defining a set of eligible player initial hands;

defining parameters n, $m_1$, and $m_2$ such that $n>1$, $m_1>1$, and $m_2 m_1$;

if said player receives a player initial hand defined within said set of eligible player initial hands, receiving from said player an election to form n player final hands, each said player final hand including both cards of said player initial hand;

if said player elects to form n player final hands each including both cards of said player initial hand, forming said n player final hands comprising:

receiving from said player a wager increase, said wager increase of between $m_1$ times said initial wager and $m_2$ times said initial wager;

dealing n additional cards;

for each of said n additional cards, forming a separate player final hand, each separate player final hand including one of said additional cards in combination with both cards of said initial player hand;

allocating said initial wager plus said wager increase among said n player final hands to form n individual hand wagers, each said individual hand wager associated with a separate player final hand; and if said player elects to form n player final hands, resolving each of said n individual hand wagers comprising:

comparing the player final hand associated with that individual hand wager against said dealer final hand;

issuing a reward based on that individual hand wager if (a) the sum of the values of the cards in the associated player final hand is closer to twenty-one, without exceeding twenty-one, than is the sum of the values of the cards in said dealer final hand or (b) the sum of the values of the cards in said dealer final hand exceeds twenty-one and the sum of the values of the cards in said player final hand is less than or equal to twenty-one; and collecting said individual hand wager if (a) the sum of the values of the cards in the associated player final hand exceeds twenty-one or (b) if the sum of the values of the cards in said dealer final hand is closer to twenty-one, without exceeding twenty-one, than is the sum of the values of the cards in the associated player final hand.

2. The method of claim 1 wherein said step of defining said parameters comprises defining said parameters such that $n=2$, $m_1>1$, $m_2=2$.

3. The method of claim 1, wherein said conventional rules of blackjack include a standard double down option in which a player with a player initial hand having a predefined hand sum may elect to place a double down wager in exchange for only one additional card dealt to said player initial hand to form a single player final hand, said method further comprising restricting a player from selecting said standard double down option if said player has a player initial hand having said predefined hand sum that also falls within said set of eligible player initial hands.

4. The method of claim 1 wherein said conventional rules of blackjack include a standard double down option in which a player with a player initial hand having a predefined hand sum may elect to place a double down wager in exchange for only one additional card dealt to said player initial hand to form a single player final hand, said method further comprising receiving a selection of either said standard double down option or an election to form n final player hands from a player having a player initial hand with said predefined hand sum that also falls within said set of eligible player initial hands.

5. The method of claim 1 wherein said conventional rules of blackjack include a standard double down option in which a player with a player initial hand having a predefined hand sum may elect to place a double down wager in exchange for only one additional card dealt to said player initial hand to form a single player final hand, said step of defining said set of eligible player initial hands comprising defining said set of eligible player initial hands to include player initial hands having said predetermined hand sum.

6. The method of claim 1 wherein said step of defining said parameters comprises defining $m_1=m_2=n$ and said step of allocating said wager plus said wager increase comprises allocating said wager plus said wager increase equally among said n player final hands such that each of said individual hand wagers is equal to said initial wager.

7. The method of claim 1 wherein said player elects to form n player final hands by placing said wager increase behind said initial wager.

8. The method of claim 1 conducted on a wagering surface having a player's area with a plurality of wagering areas, wherein said player elects to form n player final hands by placing said wager increase at a prespecified wagering area within said player's area on said wagering surface.

9. A method of conducting a card game between at least one player and a dealer comprising:

defining at least one eligible player initial hand;

receiving an initial wager from each player;

dealing a player initial hand to each player and a dealer initial hand;

for each player, if said player's player initial hand is an eligible player initial hand and said player elects to form at least two player final hands each including said entire player initial hand, forming said at least two player final hands comprising:

receiving a wager increase from said player;

allocating said initial wager plus said wager increase among said at least two player final hands so that each said player final hand is associated with an individual hand wager;

dealing at least two additional cards to said player, each of said two additional cards forming the basis for a separate player final hand;

for each additional card, forming a separate player final hand including said entire player initial hand in combination with said additional card;

calculating a hand sum for each player final hand by summing the values of the cards in the entire player initial hand in combination with the value of said additional card in that player final hand;

forming a dealer final hand by standing on said dealer initial hand or receiving at least one additional card to said dealer initial hand;

calculating a hand sum for said dealer final hand by summing the values of the cards in said dealer final hand; and for each player who elects to form at least two player final hands each including said entire player initial hand, resolving each said individual hand wager comprising:

issuing a reward based on said individual hand wager if said hand sum of said dealer final hand exceeds twenty-one and said hand sum of the associated player final hand is less than or equal to twenty-one;

issuing a reward based on said individual hand wager if said hand sum of the associated player final hand is closer to, without exceeding, twenty-one than is said hand sum of the dealer final hand;

collecting said individual hand wager if said hand sum of said associated player final hand exceeds twenty-one; and collecting said individual hand wager if said hand sum of the dealer final hand is closer to, without exceeding, twenty-one than is said hand sum of the associated player final hand.

10. A method of conducting a wager for a card game between at least one player and a dealer, said card game of the type in which an initial wager is received from each player, a player initial hand is dealt to each player and a dealer initial hand is dealt, a dealer final hand is formed from said dealer initial hand by either standing on said dealer initial hand or receiving at least one additional card to said dealer initial hand, and calculating a hand sum for said dealer final hand by summing the values of the cards in said dealer final hand, comprising:

defining at least one eligible player initial hand;

for each player holding a player initial hand that is an eligible player initial hand, receiving an election from said player to form at least two player final hands each including said entire player initial hand, and forming said at least two player final hands comprising:

receiving a wager increase from said player;

allocating said initial wager plus said wager increase among said at least two player final hands so that each said player final hand is associated with an individual hand wager;

dealing at least two additional cards to said player, each of said at least two additional cards forming the basis for a separate player final hand;

for each additional card, forming a separate player final hand including said entire player initial hand in combination with said additional card;

calculating a hand sum for each separate player final hand by summing the values of the cards in the entire player initial hand in combination with the value of said additional card in that player final hand; and for each player who elects to form at least two player final hands each including said entire player initial hand, resolving each said individual hand wager comprising:

issuing a reward based on said individual hand wager if said hand sum of said dealer final hand exceeds twenty-one and said hand sum of the associated player final hand is less than or equal to twenty-one;

issuing a reward based on said individual hand wager if said hand sum of the associated player final hand is closer to, without exceeding, twenty-one than is said hand sum of the dealer final hand;

collecting said individual hand wager if said hand sum of said associated player final hand exceeds twenty-one; and collecting said individual hand wager if said hand sum of the dealer final hand is closer to, without exceeding, twenty-one than is the hand sum of said associated player final hand.

* * * * *